US008262855B2

(12) United States Patent
Peltomäki et al.

(10) Patent No.: US 8,262,855 B2
(45) Date of Patent: Sep. 11, 2012

(54) METHOD FOR DETERMINING THE TOTAL PEROXIDE CONTENT OF PULP SUSPENSION

(75) Inventors: Teuvo Peltomäki, Kajaani (FI); Aleksi Pohjola, Kajaani (FI); Pasi Antero Keinänen, Oulu (FI)

(73) Assignee: Metso Automation Oy, Helsinki (FI)

( * ) Notice: Subject to any disclaimer, the term of this patent is extended or adjusted under 35 U.S.C. 154(b) by 847 days.

(21) Appl. No.: 12/223,442

(22) PCT Filed: Feb. 7, 2007

(86) PCT No.: PCT/FI2007/050066

§ 371 (c)(1),
(2), (4) Date: Sep. 23, 2008

(87) PCT Pub. No.: WO2007/090932

PCT Pub. Date: Aug. 16, 2007

(65) Prior Publication Data

US 2009/0025893 A1 Jan. 29, 2009

(30) Foreign Application Priority Data

Feb. 9, 2006 (FI) ..... 20065093

(51) Int. Cl.
*D21C 9/10* (2006.01)

(52) U.S. Cl. ..... 162/49; 162/263; 205/775

(58) Field of Classification Search ..... 162/49, 162/263; 205/775
See application file for complete search history.

(56) References Cited

U.S. PATENT DOCUMENTS

| | | | | |
|---|---|---|---|---|
| 3,729,375 | A | 4/1973 | Chappelle | |
| 4,525,265 | A * | 6/1985 | Abe et al. | 204/403.1 |
| 4,661,205 | A * | 4/1987 | Ow et al. | 162/78 |
| 4,734,160 | A | 3/1988 | Moldenius | |
| 4,798,652 | A * | 1/1989 | Joyce et al. | 162/60 |
| 4,878,998 | A | 11/1989 | Hook et al. | |
| 4,933,292 | A * | 6/1990 | Savisalo et al. | 436/150 |
| 6,129,831 | A * | 10/2000 | Temmerman et al. | 205/775 |
| 6,332,951 | B1 * | 12/2001 | Fladda et al. | 162/49 |
| 6,774,992 | B1 | 8/2004 | Garver et al. | |
| 2003/0070778 | A1 | 4/2003 | Lahtinen et al. | |
| 2003/0102094 | A1 | 6/2003 | Tirri et al. | |

FOREIGN PATENT DOCUMENTS

| | | |
|---|---|---|
| EP | 1 302 589 A2 | 4/2003 |
| FI | 89517 | 6/1988 |
| WO | WO 84/02366 A1 | 6/1984 |
| WO | WO 98/32914 A1 | 7/1998 |

(Continued)

OTHER PUBLICATIONS

Leiviska, Process Control, 1999, Fapet Oy, Book 14, p. 56-57 and 93-97.*

(Continued)

*Primary Examiner* — Anthony Calandra
(74) *Attorney, Agent, or Firm* — Oliff & Berridge, PLC

(57) ABSTRACT

A method and an apparatus for determining the total peroxide content of a cellulose pulp suspension in the pulp suspension bleaching stage, wherein the bleaching chemical is peroxide. A sample is taken from the pulp suspension, which sample is measured in a measuring device (25, 25'). Before measuring, the pH of the sample is adjusted and after that the total peroxide content or the perhydroxyl content of the sample is measured, of which measurement the total peroxide content of the sample is determined.

10 Claims, 6 Drawing Sheets

FOREIGN PATENT DOCUMENTS

| | | | |
|---|---|---|---|
| WO | WO 01/59437 | A1 | 8/2001 |
| WO | WO 01/86059 | A1 | 11/2001 |

OTHER PUBLICATIONS

Metso Automation, kajaaniPOLAROX Data sheet [downloaded online from http://www.latitude61.fi/Portfolio1/kajaaniPOLAROX_brochure_240403.pdf], Mar. 2003.*

Sun et al., Immobilization of horseradish peroxidase on a self-assembled monolayer modified gold electrode for the detection of hydrogen peroxide, 1998, Anlyst, vol. 123, p. 1365-1366.*

Tessier et al, .Dyanmic Modeling and Process Control of a Hydrogen Peroxide Bleaching process, 1998, IEEE Industy Applications 1998, p. 40-51.*

* cited by examiner

METHOD FOR DETERMINING THE TOTAL PEROXIDE CONTENT OF PULP SUSPENSION

FIELD OF THE INVENTION

The invention relates to a method for determining the total peroxide content of pulp suspension according to the preamble of the appended claim 1. The invention also relates to an apparatus for implementing the aforementioned method.

The bleaching method to which the invention relates is peroxide bleaching. The concept of peroxide bleaching in this application refers to bleaching with an agent that produces perhydroxyl ions. Such agents include hydrogen peroxide ($H_2O_2$), but other peroxide compounds are also possible, such as sodium peroxide and sodium percarbonate.

BACKGROUND OF THE INVENTION

Cellulose pulp can be made of wood either by mechanical processing, by refining or grinding, or chemically by cooking. The pulps produced by these methods contain lignin, which causes the brown color of pulp and has to be removed in order to produce white paper.

Most of the lignin in cellulose pulp prepared by cooking degrades during cooking. However, a part of it remains in the pulp and must be removed before directing the pulp to further processing. Removal of lignin takes place in the washing and bleaching stages following pulp cooking. In the bleaching stage bleaching chemicals are added to the pulp, which chemicals cause the brightness of the pulp to increase.

Peroxides are effective bleaching chemicals and they have been used bleaching mechanical pulp for a long time due to their high bleaching effect and environmentality. Namely, no environmentally harmful substances, for example organic chlorine compounds, are created in peroxide bleaching as they are created in bleaching methods based on chloride. The bleaching effect of the peroxide is based on oxidizing the colored chromophore radicals of lignings and rendering them colorless. Recently peroxide bleaching has been used more and more also in chemical pulp bleaching. An advantage of peroxide bleaching is the increased fiber gain of cooking, because the kappa number of the pulp to be bleached needs not be zero, but the kappa number may vary from 2 to 6 and a good bleaching result is still reached. As a result of this, the fiber gain from cooking increases. Generally peroxide bleaching is the last stage in the bleaching plant of chemical pulp.

The bleaching effect of peroxides is based on the formation of perhydroxyl ion $OOH^-$ in an alkaline solution. The following reaction shows the dissociation of hydrogen peroxide into a $OOH^-$ ion:

$$H_2O_2 \overset{pH}{\leftrightarrows} OOH^- + H^+$$

The reaction is an equilibrium reaction, which depends on the temperature and pH of the solution.

FIG. 1 shows the dependence of the reaction between perhydroxyl ion and hydrogen peroxide on the pH and temperature of the solution. As can be seen from the diagram, the importance of temperature on the formation of perhydroxyl ion is small. However, the pH of the solution has a conclusive significance in the formation of perhydroxyl ion. It can be seen in the diagram that when the pH is below 9, hydrogen peroxide is approximately 100% in peroxide molecular form. Whereas when the pH is over 11, i.e. very alkaline, approximately 100% of hydrogen peroxide is in perhydroxyl ion form.

Thus, in peroxide bleaching the aim is to maintain the pH of pulp suspension on such a range that the perhydroxyl ion content would be high enough and that the desired final brightness target of pulp would be reached. The pH is controlled by means of an alkaline chemical, generally sodium hydroxide (NaOH), but magnesium oxide (MgO) can also be used.

Currently the peroxide bleaching stage is controlled by measuring the brightness of the bleached pulp and the amount of peroxide and pH in the suspension both before and after the peroxide bleaching tower. The brightness of the pulp is compared with the desired target brightness and on the basis of that and the peroxide measurements and pH the amount of peroxide and sodium hydroxide supplied to the bleaching tower is controlled. The measurements are generally performed as laboratory measurements. Currently the measurements can also be performed with on-line and/or in-line analyzers.

The level of the in-line or on-line measurements measuring the amount of peroxide and especially the condition of the measuring devices performing the measurements are tested by measuring samples from the pulp suspension at certain intervals in a laboratory. By comparing the laboratory measurements and the measurements of the on-line measuring devices it is possible, for example, to conclude whether the measuring device is in working order. The laboratory measurements as such are not well suited for controlling the bleaching stage due to their slowness. The most common used laboratory measurements are based on determining the amount of total peroxide, which is performed by titrating.

For measuring the amount of peroxide in the suspension as on-line measurement, measuring methods based on electrochemical measuring are generally used. These methods measure the electric current produced by a filtrate sample taken from the pulp suspension. The pulp suspension and thus also the filtrate sample contain both peroxide molecules and perhydroxyl ions. The electrochemical diffusion current created by a perhydroxyl ion is approximately ten times stronger than the electrochemical diffusion current created by the peroxide molecule. This means that this measuring method in practice measures the electric current created by the perhydroxyl ions of the sample and the perhydroxyl ion content, and is therefore not comparable with the laboratory measurement measuring the total peroxide content. Thus, the mutual correlation of these measurement is poor.

U.S. Pat. No. 6,332,951 discloses a method for measuring peroxide content of pulp suspension in the bleaching stage, which is based on catalytical decomposition of peroxide. In this method catalyst is added to a sample taken from the suspension, and the catalyst causes the peroxide to decompose into water and oxygen. The oxygen formed in the reaction vessel forces a part of the sample into a measurement chamber. The pressure of the measurement chamber corresponds to the total peroxide amount in the sample. The correlation of this measurement with the laboratory measurements is quite good, but the problem with; the measurement is its complexity as well as the deviations in the measurement results caused by sample handling and maintenance of the equipment.

U.S. Pat. No. 6,774,992 shows a method for determining the peroxide and/or perhydroxyl ion contents of a pulp suspension to be bleached. In the method of the publication the sample is analyzed optically by Raman spectroscopy and the peroxide and perhydroxyl ion contents are determined from the peak intensities of the measured spectrum. According to the publication these contents can, together with the brightness measurements performed on the pulp, be used in controlling the amount of peroxide solution used in bleaching. A problem with the measurement is cleansing of the optics in the measurement equipment and problems with the repeatability of measurements.

FI-publication 89517 (corresponding U.S. Pat. No. 4,878,998) shows a control method of a two-stage mechanical pulp bleaching process. In the method the brightness of the pulp is measured after the bleaching tower and the residual peroxide amount in the backwater received at the press from the pulp after bleaching tower. In addition, the pH of the backwater is measured. The measuring results are used in controlling the amount of peroxide supplied to the bleaching stage. A problem with the solution disclosed in this publication is that by measuring the total peroxide amount of the backwater no knowledge of how much of the peroxide is in an active perhydroxyl ion form is formed. As a result of this the amount of peroxide added to the bleaching tower is not correct.

BRIEF DESCRIPTION OF THE INVENTION

Therefore, the purpose of the present invention is to provide a method for determining the total peroxide content of a cellulose pulp suspension in the pulp suspension bleaching stage, which avoids the above-mentioned problems and with which the bleaching stage using peroxide as bleaching chemical can be controlled precisely. Furthermore, it is an aim of the invention to provide an apparatus implementing the aforementioned method.

To attain this purpose, the method according to the invention is primarily characterized in what will be presented in the characterizing part of the independent claim 1.

The measuring apparatus according to the invention, in turn, is primarily characterized in what will be presented below.

The other, dependent claims will present some preferred embodiments of the invention.

The invention is based on the idea that the total peroxide content, i.e. the content of the peroxide in peroxide molecule form, of a sample taken from the pulp suspension in the bleaching stage is determined by a measuring device arranged in connection with the bleaching stage. Determining the total peroxide content of the sample can be performed in two different ways, either by directly measuring the total peroxide content of the sample, or by measuring the total perhydroxyl ion content of the sample and determining the total peroxide content of the sample from that. Depending on which of these determinations is used, the pH of the sample is adjusted onto the correct level for the measurement.

For measuring the total peroxide content of the sample the pH of the sample is adjusted very alkaline by adding alkaline reagent, such as sodium hydroxide (NaOH). Advantageously sodium hydroxide is added to the sample in such an amount that the pH of the sample is over 11. This results in that in addition to the perhydroxyl ions contained in the sample, all the peroxide molecules in the sample dissociate into perhydroxyl ions. Thus, the sample to be measured contains only perhydroxyl ions, whose content can be measured and on the basis of the measurement the total peroxide content of the sample can be determined. Another alternative is to adjust the pH of the sample below 9 by adding a pH decreasing reagent, such as hydrochloric acid (HCl), in it in such an amount that the pH of the sample is below 9, in which case all the perhydroxyl ions in the sample transform into peroxide molecules. Thus, the sample contains both the peroxide molecules contained in it before adjusting the pH, and the peroxide molecules resulting from adjusting the pH. By measuring this sample the total peroxide content of the sample is provided directly.

The total peroxide content of the pulp suspension in the peroxide bleaching stage is determined with a measuring apparatus connected to the bleaching stage. The measuring apparatus comprises an electrochemical measuring device, which contains three electrodes, a current, a reference and a measuring electrode. The electric current measured by the measuring electrode directly represents the content of the measured agent in the solution. In addition, the measuring apparatus contains means for controlling the pH of the measured sample. The measuring apparatus can be arranged to measure pulp suspension as such, but preferably it is arranged to measure filtrate samples taken from the pulp suspension with a sampler.

An advantage of the measuring method according to the invention is that the total peroxide content resulting from the measurement or determined from the measurement correlates very well with the laboratory measurements received with the titrating method. FIG. 2 shows results from practical tests, where peroxide residue is measured from the pulp suspension samples taken approximately 15 seconds after peroxide addition. Two samples are taken at each sampling time. The total peroxide content of one sample is measured in a laboratory with a titrating method and the total peroxide content of the other sample is determined from the measuring results received from the measuring apparatus according to the invention. In the measurements performed with the measuring apparatus the sample is made alkaline with sodium hydroxide and the perhydroxyl ion content is measured form it, from which the peroxide content of the sample is determined. As can be seen from the diagram, the correlation between the laboratory measurements and the determination according to the invention is excellent.

The measuring apparatus according to the invention is easy to use, and it does not include any parts that are difficult to clean. In addition, the measuring apparatus is small, which enables its installation in narrow surrounding of the bleaching plant. The measurement is quick and the measuring apparatus can be used for on-line control of the bleaching process. If the bleaching plant already includes an electrochemical perhydroxyl-ion-content-measuring device according to prior art, the equipment necessary for controlling the pH of a sample can be added to it simply and easily.

If the invention is implemented in a measuring device measuring perhydroxyl ion content, this measuring apparatus can be used for controlling the bleaching stage. By means of the measuring apparatus it is possible to measure both the perhydroxyl ion and total peroxide contents of the pulp suspension, in which case it is possible to determine how much of the peroxide supplied to the pulp is dissociated to active perhydroxyl ion form. On the basis of this determination the pH of the bleaching stage can be controlled so that the perhydroxyl ion content is on the optimal area from the point of view of the desired bleaching result. Controlling the pH is performed by controlling the amount of the alkaline chemical supplied to the bleaching stage. Simultaneously the total peroxide content of the bleaching stage is controlled by controlling the amount of peroxide supplied to the bleaching stage. The total peroxide content and the perhydroxyl ion content of the sample taken from the pulp suspension can be determined either with one measuring apparatus as sequential measurements or with two measuring devices that are connected either in series or in parallel.

The necessary peroxide dose is affected by pulp brightness as well. Pulp brightness is measured with an on-line measuring device before adding peroxide to the pulp, i.e. before the bleaching tower. On the basis of the brightness measurement performed before the peroxide addition, the amount of peroxide added to the pulp is controlled by means of feedforward ratio control. In addition, the amount of peroxide is controlled by means of a total peroxide measurement arranged after the peroxide addition, by using feedback control. In addition to this, the end brightness of pulp and the total peroxide content of the pulp suspension is measured after the bleaching tower, and on the basis of these measurements the amount of peroxide to be added to the pulp is controlled by using feedback control.

Thus, the invention enables precise control of the bleaching stage. By means of it the brightness of the pulp from bleaching is brought closer to the target value. In addition, the amount of chemicals used in the bleaching stage can be decreased, because the peroxide amount needed in bleaching can be controlled precisely. This often has a positive effect on the strength properties of pulp as well.

The measuring apparatus can be placed in the desired point of the bleaching stage. Advantageously it is placed to measure pulp suspension at least after the bleaching tower. If the measuring apparatus is used for controlling the bleaching stage, at least one of them is placed both before and after the bleaching tower.

BRIEF DESCRIPTION OF THE DRAWINGS

In the following, the invention will be described in more detail with reference to the appended drawings, in which

In FIGS. 3 to 7, the same numerals refer to corresponding parts and they will not be explained separately later on, unless required by the illustration of the subject matter.

DETAILED DESCRIPTION OF THE INVENTION

The term line in this description refers to any pipe, duct or channel suitable for transferring a solution or a suspension.

Figure 1:
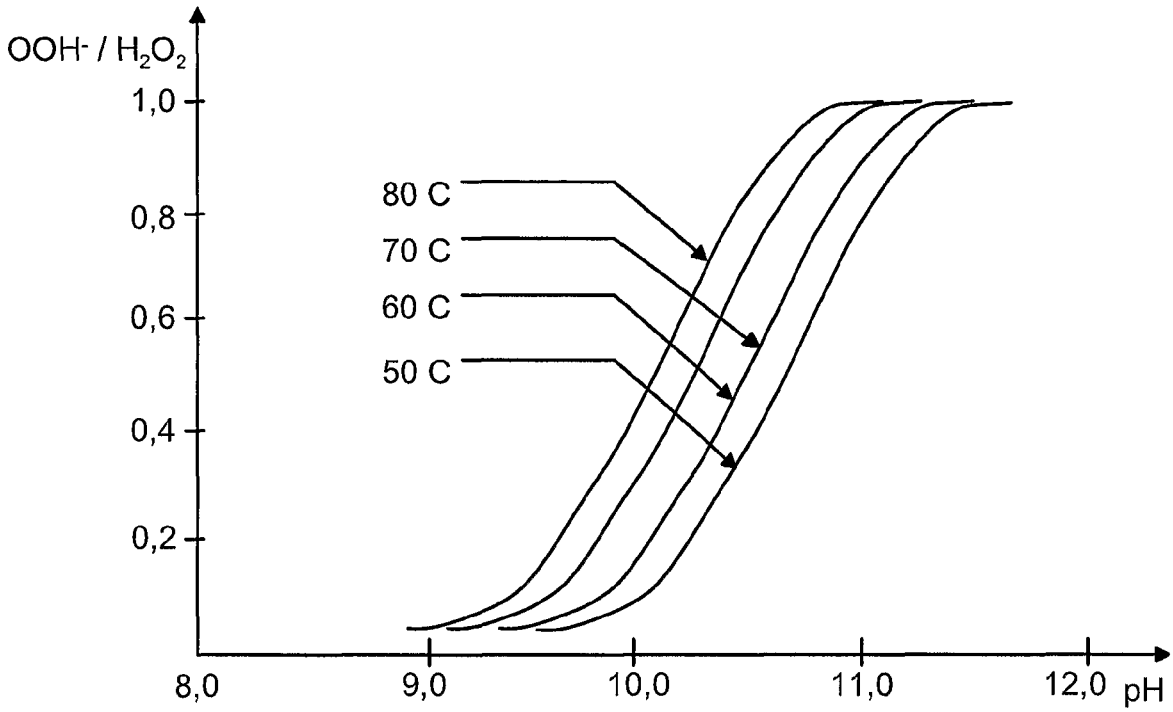
FIG. 1 shows the dependency of the peroxide dissociation reaction on the pH and temperature of the solution.
Figure 2:
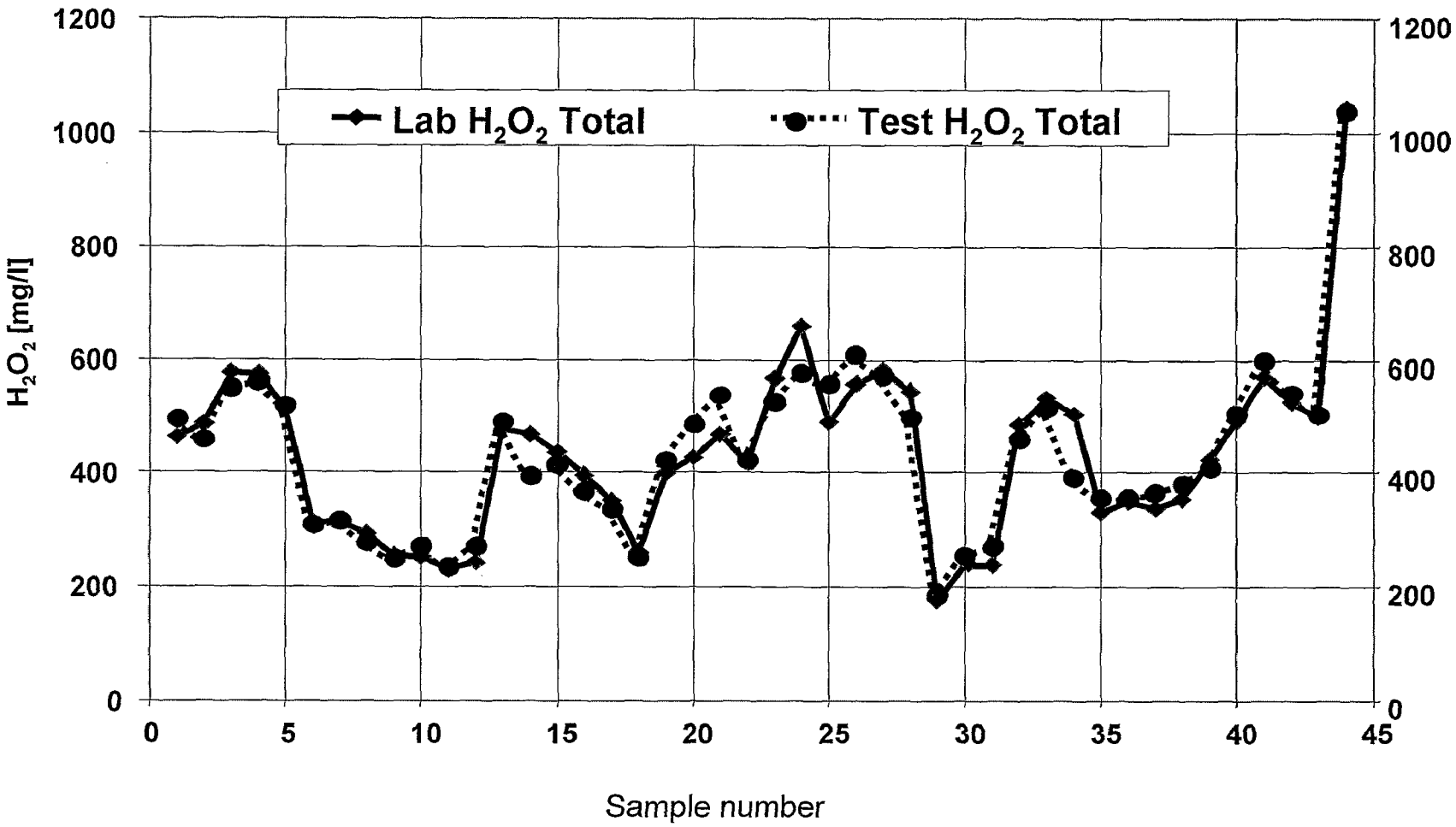
FIG. 2 shows total peroxide contents measured in a laboratory and determined by the method according to the invention.
Figure 3:
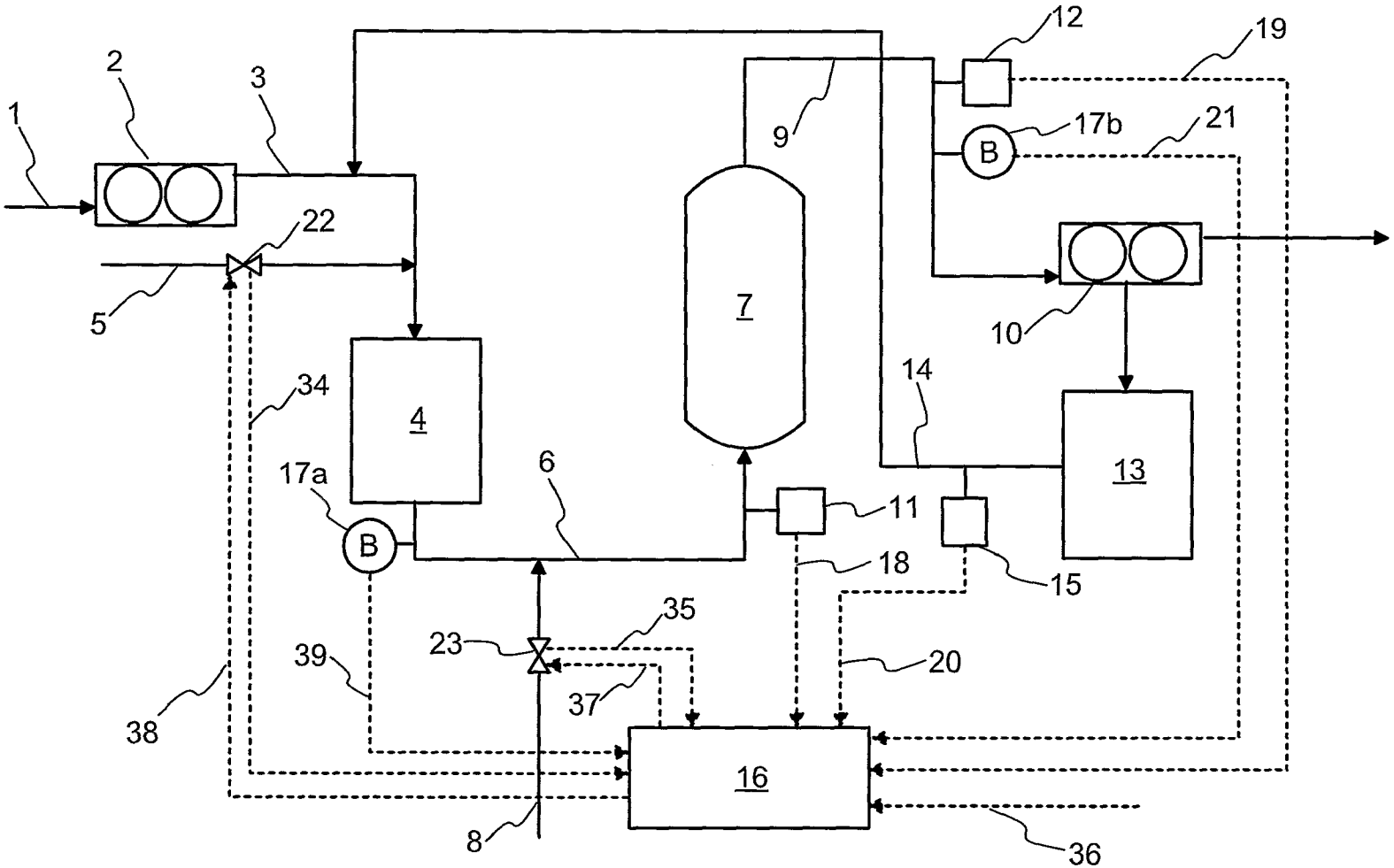
FIG. 3 is a schematic view showing the cellulose pulp bleaching stage and an embodiment for controlling it.

FIG. 3 is a schematic view showing the bleaching stage used in bleaching cellulose pulp. In a bleaching plant of a cellulose mill there are typically several bleaching stages, of which the bleaching stage using peroxide as bleaching chemical is typically placed last. It is also possible to divide the peroxide bleaching stage into two sequential bleaching stages.

The pulp to be bleached is supplied via line 1 to a pulp press 2, where a part of the water in the pulp is removed. From the press 2 the pulp is conveyed via a line 3 to a pulp tank 4. To the line 3 is connected a line 5 for supplying alkaline chemical, such as sodium hydroxide, into the pulp. From the tank 4 the pulp is conveyed via a line 6 to a bleaching tower 7. To the line 6 is connected a line 8 for supplying peroxide-containing chemical, such as hydrogen peroxide, into the pulp suspension. From the bleaching tower 7 the pulp suspension that has reacted with the peroxide is conveyed via a line 9 to a pulp press 10 and further in the process.

The amount of the alkaline chemical and peroxide supplied to the pulp suspension is controlled by control means 22 that control the amount of alkaline chemical and that are installed in connection with lines 5 and 8, as well as by control means 23 that control the amount of peroxide. The control means 22 and 23 can be any control means suitable for controlling the amount of fluid reagent, such as valves or pumps.

The filtrate water from the pulp press 10 after the bleaching tower 7, i.e. backwater is collected in a backwater tank 13 and conveyed from there via a line 14 as dilution water to the pulp supplied to the bleaching tower 7. The line 14 is connected to the line 3 conveying pulp before the alkali addition line 5 in the flow direction of pulp.

The perhydroxyl and total peroxide content of the pulp suspension, as well as the pH are measured both before and after the bleaching tower 7 with measuring apparatuses 11 and 12. The measuring apparatus 11 before the bleaching tower is arranged in connection with the line 6, after the supply line 8 of peroxide in the flow direction of pulp. After the bleaching tower 7 the measuring apparatus 12 is arranged in connection with the line 9, before the press 10. The perhydroxyl and total peroxide contents, as well as the pH of the backwater are measured with a measuring apparatus 15 arranged in connection with the line 14. The pulp brightness value needed in controlling the bleaching stage is measured both before the bleaching tower 7 with a first brightness measuring device 17*a* arranged in connection with the line 6, and before the pulp press 17*a* with a second brightness measuring device 17*b* arranged in connection with the line 9. It is also possible to measure the pulp brightness value in a laboratory. In that case, the pulp sample needed in the measurement is taken substantially from the same position as where the aforementioned brightness measuring devices 17*a* and 17*b* are placed. It is also possible to measure brightness with a measuring device, which simultaneously measures the kappa number of pulp.

The peroxide bleaching of cellulose pulp is known as such for a person skilled in the art, and it will therefore not be described in more detail in this context. The apparatus of the bleaching stage also comprises various pumps, valves, chemical mixers and pipeworks, as well as other parts, which are not presented for reasons of clarity.

Figure 4:
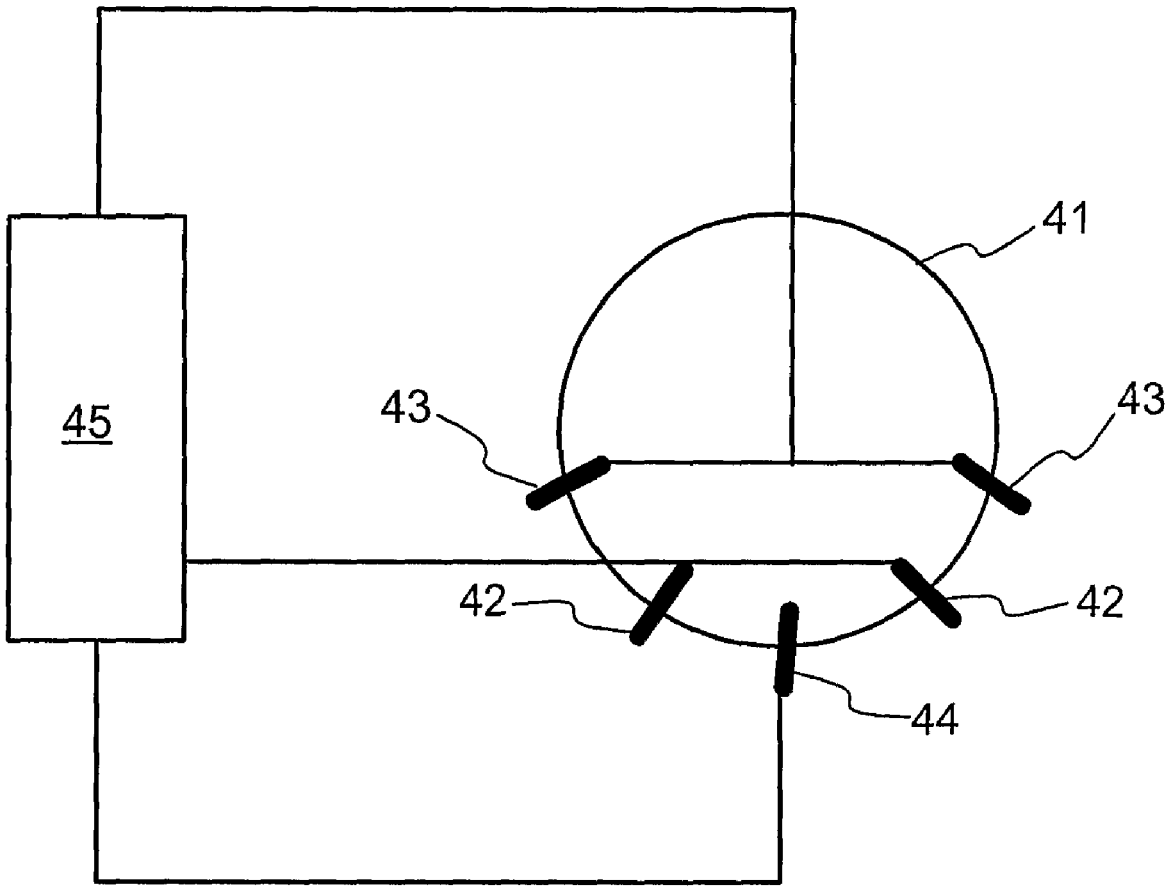
FIG. 4 is a schematic view showing the measuring arrangement of a measuring device used in measuring the total peroxide content.

The measuring apparatuses 11, 12 and 15 are substantially identical measuring apparatuses, which comprise of at least one measuring device based on an electrochemical measuring practice and reagent addition means necessary for controlling pH. FIG. 4 shows a measuring system of a measuring device. The measuring device contains a measuring chamber 41, where the sample to be measured is conveyed. In the measuring chamber are arranged measuring electrodes 42, current electrodes 43 and a reference electrode 44, which come into contact with the sample, and which are connected to an electronics part 45. The electronics part 45 controls the setting potential between the measuring electrodes 42 and reference electrode 44, which potential is kept constant during the entire measurement. The setting potential is selected according to the measured chemical. As a result of the oxidation and dissociation reactions of the measured chemical taking place on the surface of the measuring electrodes 42, the potential difference between the measuring electrodes 42 and reference electrode 44 tends to change. This change is prevented by supplying current to the measuring electrodes 42 via the current electrode 43. The supplied electric current is directly proportional to the content of the compound being analyzed. The above-described electrochemical measuring system is self-evident for a person skilled in the art, and it will therefore not be described in more detail in this context.

Figure 5:
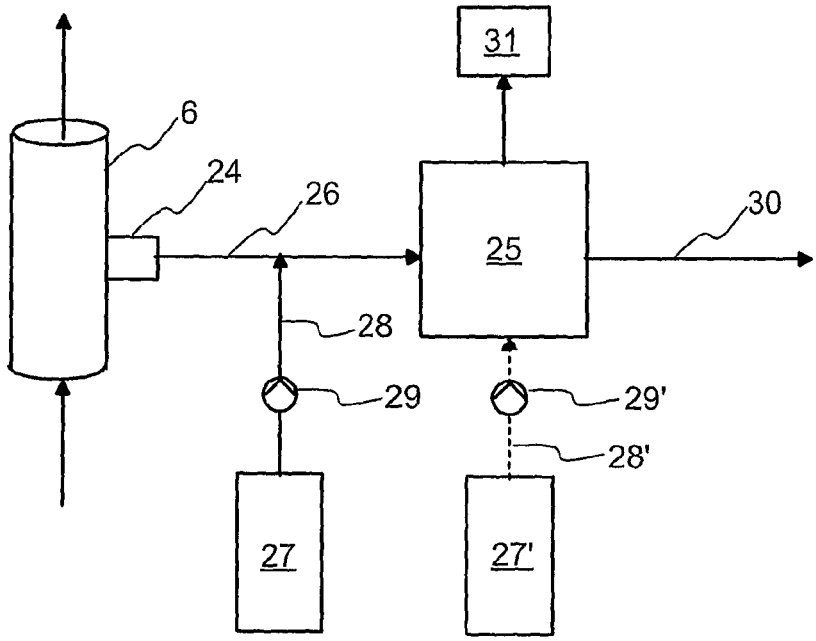
FIG. 5 is a schematic view showing a measuring apparatus according to the invention.

FIG. 5 is a schematic view showing the measuring apparatus 11 of FIG. 3 for determining the total peroxide content of pulp suspension. The other measuring apparatuses 12 and 15 of FIG. 3 are substantially similar to the measuring apparatus 11 described here. The measuring apparatus consists of a measuring device 25, whose measuring arrangement is in accordance with the arrangement described in connection with FIG. 4, and of control means 27 and 29 for the pH of the sample. For taking a sample to be measured, a sampler 24 is arranged in the line 6 conveying the pulp suspension, which line 6 is a part of the peroxide stage. The sampler is advantageously a filtrate sampler, with which a sample of the solution contained by the pulp suspension is obtained, which sample does not include fibers or other particles. The sampler 24 is connected to the measuring device 25 with a line 26.

The pH control means consist of a tank 27, which contains a solution needed in adjusting the pH of the sample, for example sodium hydroxide or hydrochloric acid solution. The tank is connected with a line 28 to the line 26 conveying the sample from the sampler to the measuring device. The control means also comprise a pump 29 for supplying the solution used in adjusting pH, which pump is arranged in connection with the line 28.

After the measurement the sample is either returned via a line 30 back to the pulp suspension or conveyed to the waste water processing system of the mill.

For measuring the total peroxide content of the pulp suspension the pH of the sample taken by the sampler 24 from the line 6 is adjusted by adding to it either an alkaline reagent that increases the pH, such as sodium hydroxide, or a reagent that decreases the pH, such as hydrochloric acid. The reagent is added to the sample from a reagent tank 27 by means of a pump 29. The reagent is selected on the basis of the desired manner of determining the total peroxide. If the aim is to get the total peroxide content of the sample directly from the signal provided by the measurement, hydrochloric acid is used in adjusting the sample pH. The pH is thus adjusted to be below 9. The other possibility is to determine the total peroxide content of the sample by adding sodium hydroxide in such an amount to it that the pH of the sample is over 11 when it flows to the measuring device 25 to be measured. When the pH is increased over 11, the peroxide molecules in the sample dissociate into perhydroxyl ions. The measuring device 25 thus measures the total amount of perhydroxyl ions in the sample before the sodium hydroxide addition and the total amount created by the sodium hydroxide addition. Thus, the total peroxide content of the sample can be calculatively determined. Determining the total peroxide content can be performed either in a separate control unit 31 in connection with the measuring device, or in a control unit 16 controlling the bleaching stage.

The reagent needed in measuring the total peroxide content can also be supplied directly to the measuring cell of the measuring device. For this, a reagent supply line 28', a reagent tank 27', as well as a pump 29' marked in FIGS. 5 and 6 by dashed lines are arranged in the measuring device.

With the above-described measuring it is possible to control the amount of peroxide supplied to the bleaching stage.

The measuring apparatuses 11, 12 and/or 15 are very well suited for controlling the pulp bleaching stage. With the measuring apparatus according to FIG. 5 the perhydroxyl ion content of the pulp suspension can be measured as well, in which case the ratio of total peroxide and perhydroxyl contents can be determined. With that it is possible to control the amount of alkaline reagent supplied to the pulp suspension. When measuring the perhydroxyl ion content of the sample, the sample taken with the sampler 24 is conveyed directly to the measuring device 25, without pH control. The perhydroxyl content of the sample is received directly from the measurement.

In the embodiment according to FIG. 5, separate samples are taken for both measurements, for measuring the perhydroxyl ions and the total peroxide content. The measurements therefore take place successively in time. A single measurement lasts approximately 2 to 3 minutes, which in addition to the measurement itself includes the change and stabilization times of the sample.

It is also possible to measure the perhydroxyl ion and total peroxide contents of the pulp suspension from the same sample by installing two measuring devices 25 in series, in which case one measuring device measures the perhydroxyl ion content of the sample and the other measuring device measures the total peroxide content of the sample. Such an embodiment is schematically shown in FIG. 6.

Figure 6:
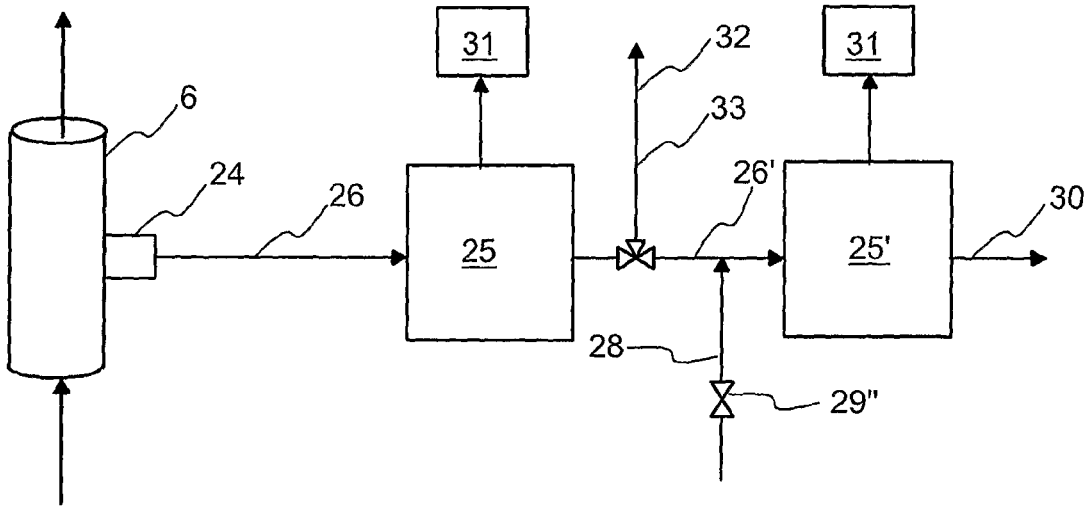
FIG. 6 is a schematic view showing a second measuring apparatus according to the invention.

In the measuring apparatus shown in FIG. 6 two identical measuring devices are installed in series so that the sample taken from the line 6 by the sampler 24 flows first to the first measuring device 25 in the flow direction to be measured. In the first measuring device 25 the measurement of the perhydroxyl ion content of the sample is performed. From the first measuring device 25 the sample flows via a line 26' to the second measuring device 25', where the measurement of the total peroxide content of the sample is performed. For measuring the total peroxide content, the pH of the sample is increased over 11 by adding sodium hydroxide to it. The sodium hydroxide is added to the sample before the measuring device 25', to the sample transfer line 26' connecting the measuring devices 25 and 25' via a reagent supply line 28. The amount of sodium hydroxide in controlled by means of a valve 29' arranged in the line 28.

If only the perhydroxyl ion content of the sample is desired to be measured with the apparatus according to the embodiment according to FIG. 6, the sample is conveyed out of the measuring device after the first measuring device 25. For this purpose a line 32 and a valve 33 for conveying the sample out of the measuring apparatus are arranged in the line 26' carrying the sample.

Figure 7:
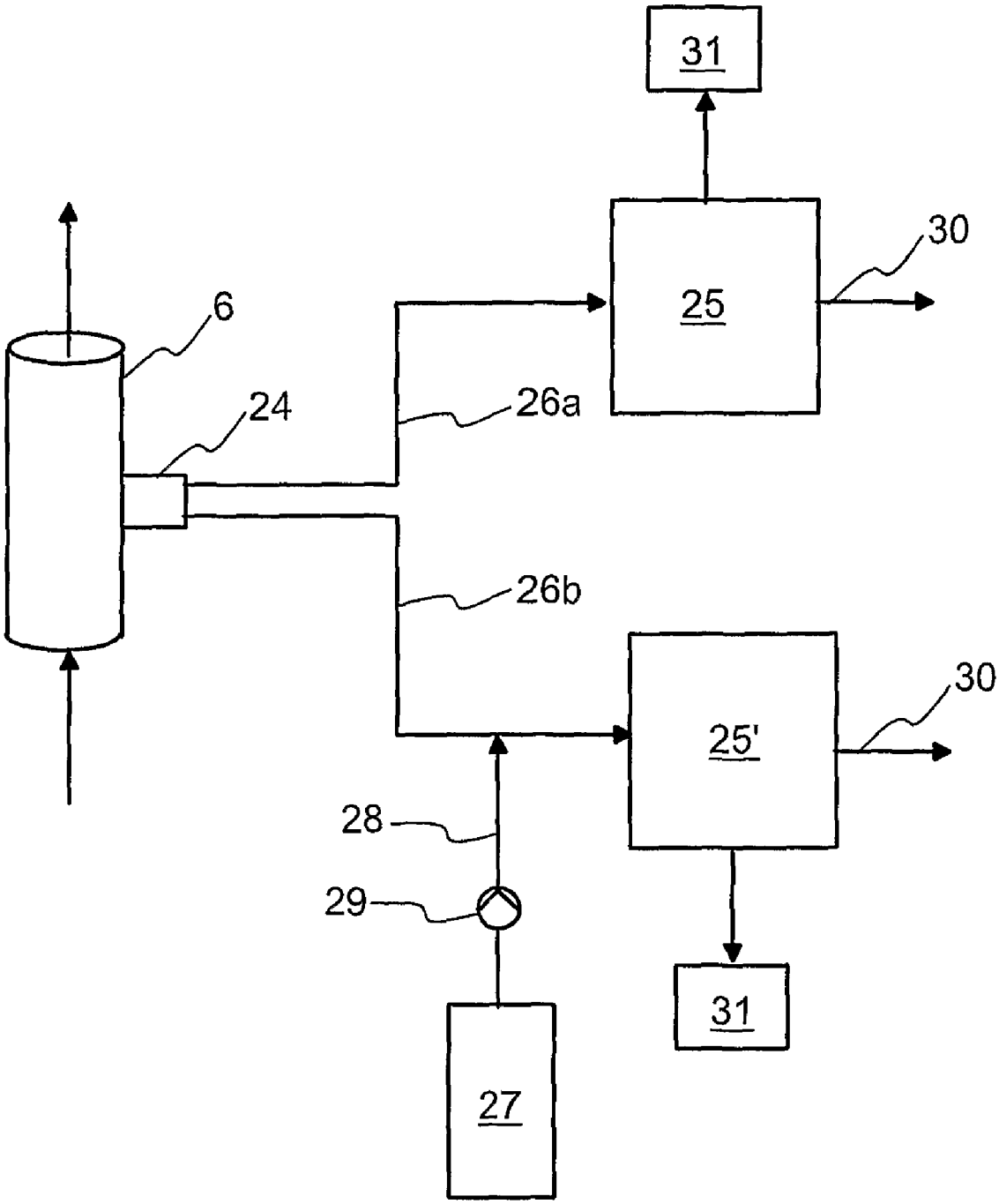
FIG. 7 is a schematic view showing a third measuring apparatus according to the invention.

FIG. 7 shows an embodiment, where two measuring devices 25 are installed in parallel, in which case, as in the embodiment shown in connection with FIG. 6, one measuring device measures the perhydroxyl ion content of the sample and the other measuring device measures the total peroxide content of the sample. When performing measurements a sampler 24 takes a separate sample sequentially for both measuring devices from a line 6.

The first sample taken by the sampler 24 flows via a line **26*a* to the first measuring device 25 to be measured. In the first measuring device the measurement of the perhydroxyl ion content of the sample is performed. The second sample taken by the sampler 24 flows via a line 26*b* to the second measuring device 25', where the measurement of the total peroxide content of the sample is performed. For measuring the total peroxide content, the pH of the sample is increased over 11 by adding sodium hydroxide to it. Sodium hydroxide is added to the second sample flowing in the sample transfer line 26' before the measuring device 25' from a tank 27 by means of a pump 29. When desired, the measurement of the total peroxide content can be performed from the first sample taken by the sampler 24 and the perhydroxyl content measurement can be performed from the second sample taken by the sampler 24**.

In embodiments containing two measuring devices according to FIGS. 6 and 7, a single measurement lasts approximately 20 seconds.

In the embodiments according to FIGS. 5 to 7 the reagent control means used for adjusting the pH of the sample may consist of a reagent tank and a pump, as shown in FIGS. 5 and 7. Instead of the pump it is possible to use other means controlling the reagent flow as well, such as a valve. It is also possible, as shown in the embodiment according to FIG. 6, to convey the reagent used in adjusting the pH directly along a pipeline to the sample and to control the amount of reagent, for example, by a valve.

Further, the dashed lines in FIG. 3 show an example of controlling the bleaching stage when a measuring apparatus according to the above is placed in the bleaching stage. For controlling the pulp bleaching, a control unit 16 is arranged in the apparatus, to which unit the measuring values 18, 19 and 20 shown by dashed lines in the figures and registered by the measuring devices 11, 12 and 15 are transmitted. In addition, information on the sodium hydroxide amount 34 and the peroxide amount 35 added to the pulp suspension is transmitted to the control unit, as well as a pulp brightness value 39 measured before the bleaching stage and a pulp brightness value 21 measured after the bleaching stage.

In the control unit the measurement and other information transmitted to it are processed with control algorithms, resulting in control messages for the control means 22 and 23 controlling the supply of sodium hydroxide and peroxide.

Before bleaching a target value 36 is determined for pulp brightness, which value is entered to the control unit 16. The pulp brightness received after the bleaching tower 7 are measured with a brightness measuring device 17*b* is compared with the target value and on the basis of that the amount of peroxide added to the pulp suspension is controlled. The control unit 16 sends a control message 37 on the basis of the comparison to the control means 23 controlling the amount of peroxide. The amount of supplied peroxide is also controlled by means of the pulp brightness value 39 measured before the bleaching tower, which value is entered to the control unit 16. The control unit sends a control message on the basis of this brightness value to the control means 23 controlling the amount of peroxide. Simultaneously the perhydroxyl and total peroxide contents as well as the pH of the pulp suspension traveling in lines 6 and 9 are monitored on the basis of the measuring values provided by the measuring devices 11 and 12. The total peroxide contents of the pulp measured or determined before and after the bleaching tower are also used for controlling the amount of peroxide supplied to the pulp suspension. The control unit 16 sends a control message on the basis of the measured total peroxide contents to the control means 23 controlling the amount of peroxide supplied to the pulp suspension. On the basis of the measuring values measured by the measuring devices 11 and 12 the ratio of the perhydroxyl ions and the total peroxide content prevailing in the bleaching tower 7 is determined, and on the basis of that the amount of alkaline chemical supplied to the pulp suspension is controlled. The control takes place so that the control unit 16 sends a control message 38 to the control means 22, which controls the amount of alkaline chemical supplied to the pulp suspension. Thus, optimal conditions are created for the formation of perhydroxyl ions in the bleaching process and the final brightness of the pulp is affected. When the final brightness settles in the target value, the amount of hydrogen peroxide supplied to the pulp suspension can be decreased, and therefore chemical expenses can be saved.

The measured perhydroxyl and total peroxide content, as well as the pH of the dilution water/backwater are also taken into account when controlling the amount of alkaline chemical and peroxide.

The invention is not intended to be limited to the embodiments presented as examples above, but the invention is intended to be applied widely within the scope of the inventive idea as defined in the appended claims.

The invention claimed is:

1. A method for determining a total peroxide content of a pulp suspension comprising:

taking at least one sample from the pulp suspension, from which the sample is measured in an electrochemical measuring device; and measuring a) a total peroxide content of the sample;

or b) a perhydroxyl ion content of the sample, of which measurement the total peroxide content of the sample is determined;

wherein, before either measurement, a pH of the sample is adjusted.

2. The method according to claim 1, further comprising:

adjusting the pH of the sample to above 11 by adding alkaline reagent to it, which causes the pH to rise.

3. The method according to claim 2, further comprising:

adding sodium hydroxide to the sample.

4. The method according to claim 1, further comprising:

adjusting the pH of the sample to below 9 by adding reagent to it, which causes the pH to decrease.

5. The method according to claim 4, further comprising:

adding hydrochloric acid or sulphuric acid to the sample.

6. The method according to claim 1, further comprising:

adding peroxide to the pulp suspension;

determining the total peroxide content of the pulp suspension; and controlling an amount of peroxide added to the pulp suspension based on the determined total peroxide content.

7. The method according to claim 6, further comprising:

adding alkaline reagent to the pulp suspension for adjusting a pH of the pulp suspension.

8. The method according to claim 7, further comprising:

measuring the perhydroxyl ion content of the sample before adjusting the pH of the sample;

determining a ratio of the perhydroxyl ion content and the total peroxide content of the sample; and controlling the pH of the pulp suspension by adjusting an amount of the alkaline reagent added to it based on the ratio of the perhydroxyl ion content and the total peroxide content of the pulp suspension.

9. The method according to claim 6, further comprising:

measuring a brightness of the pulp suspension before passing a bleaching tower; and controlling the amount of peroxide added to the pulp suspension by means of the measured pulp suspension brightness.

10. The method according to claim 6, further comprising:

setting a target value for a pulp brightness received from bleaching;

measuring the brightness of the pulp suspension after passing the bleaching tower; and determining a difference value of the pulp suspension brightness based on the target value of brightness and the measured pulp suspension brightness, wherein the amount of peroxide added to the pulp suspension is controlled based on the difference value.

* * * * *